United States Patent [19]

Stolz

[11] 4,006,570

[45] Feb. 8, 1977

[54] WALL STRUCTURE AND MANUFACTURING METHOD THEREFOR

[76] Inventor: Owen M. Stolz, 845 W. Centerville Road, Dayton, Ohio 45459

[22] Filed: Apr. 1, 1974

[21] Appl. No.: 456,713

[52] U.S. Cl. ..... 52/432; 52/438; 52/587; 52/245

[51] Int. Cl.[2] ..... E04B 2/00

[58] Field of Search ..... 52/432, 437, 438, 600, 52/601, 602, 587, 745, 259, 223 R, 583, 744, 417

[56] References Cited

UNITED STATES PATENTS

| | | | |
|---|---|---|---|
| 2,655,710 | 10/1953 | Roensch et al. | 52/600 X |
| 2,920,475 | 1/1960 | Graham | 52/432 |
| 2,969,619 | 1/1961 | Didrick | 52/600 X |
| 3,572,956 | 3/1971 | Liscum | 52/744 X |
| 3,744,202 | 7/1973 | Hubmann | 52/600 |
| 3,803,788 | 4/1974 | Artmann | 52/432 X |

*Primary Examiner*—Price C. Faw, Jr.
*Assistant Examiner*—Carl D. Friedman
*Attorney, Agent, or Firm*—Irvin V. Gleim

[57] ABSTRACT

The present invention relates to wall structure and components thereof and manufacturing methods therefor and, more particularly, in view of present energy crisis considerations, to a structural assembly comprising a plurality of individual components interconnected to form an integrated unitary structure of desired configuration such as but not limited to parabolic and/or other curved surfaces forming troughs, saucers, domes, flat wall structures and/or combinations thereof, some of which have particular utility in connection with reception and collection of various kinds of radiant energy including solar energy, without requiring or utilizing a pre-erected frame structure.

3 Claims, 14 Drawing Figures

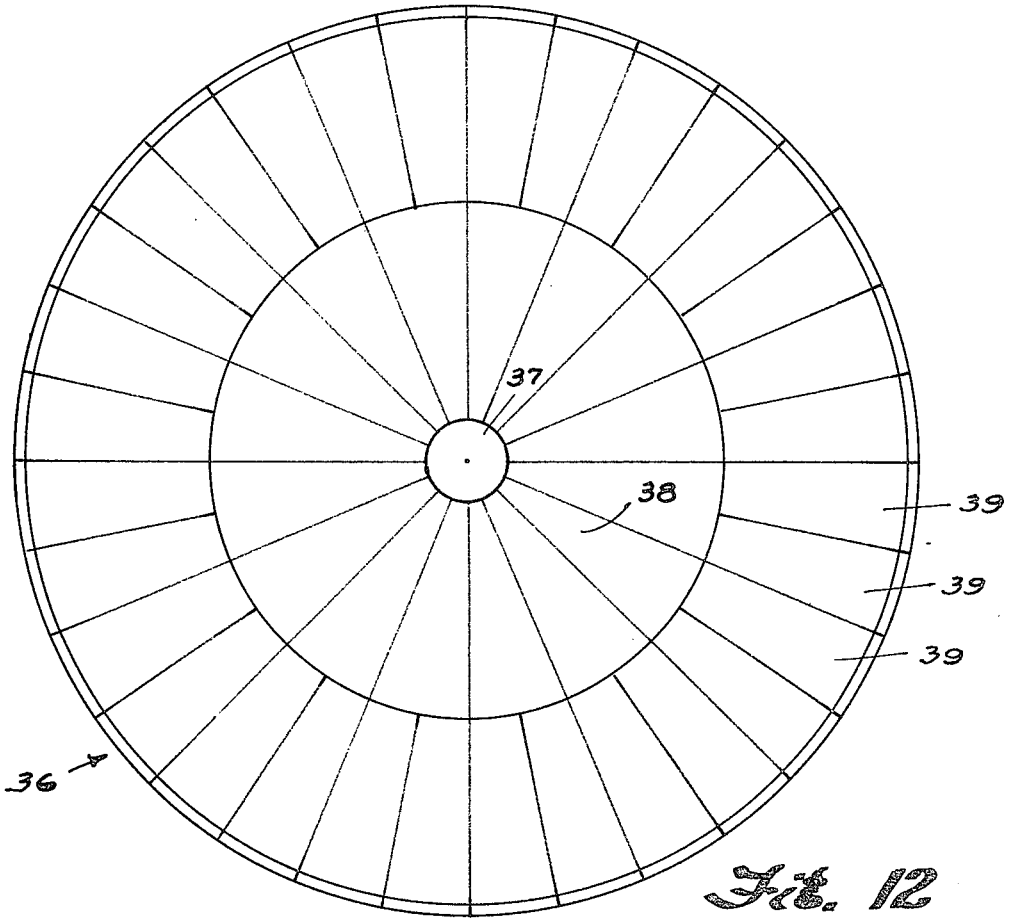
Fig. 12
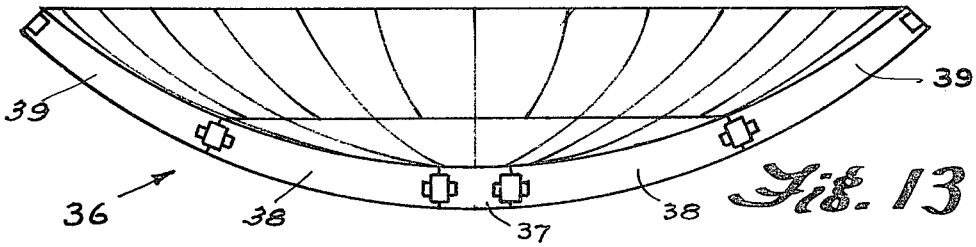
Fig. 13
Fig. 14
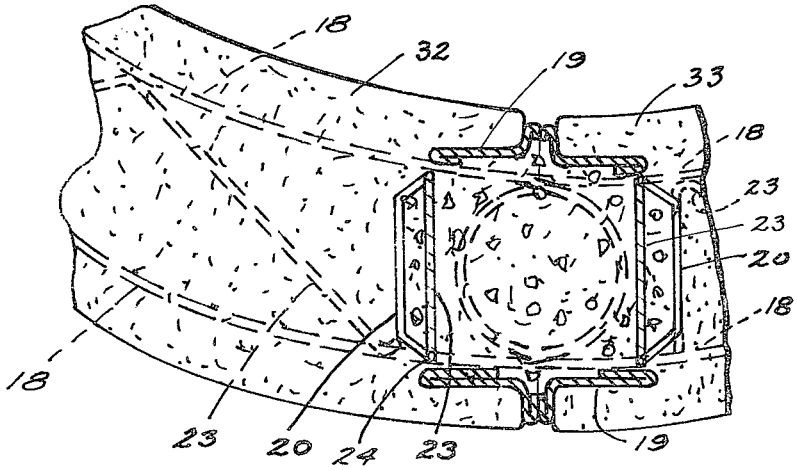

WALL STRUCTURE AND MANUFACTURING METHOD THEREFOR

BACKGROUND

The present invention relates to wall structure and manufacturing methods therefor and, more particularly, to a load-bearing structural assembly comprising a plurality of individual components interconnected to form an integrated unitary structure without requiring or utilizing a pre-erected framing structure.

Heretofore, in the erection of buildings of almost any type it has been customary to erect suitable framing structure in order to provide strength, rigidity, load-bearing capacity, etc., commensurate with forces and/or loads which the building structure is intended to withstand. Thereafter, other building components were suitably connected to the previously erected framing structure. Such other components included, but were not necessarily limited to, inner and outer walls, floors, ceilings, and roof panels for enclosing or subdividing space within the framing structure. Certain walls and floors were designed as load-bearing components while others were not necessarily intended for a load-bearing function.

Although concrete has been used successfully in at least some of the aforementioned building components, the use of concrete involves certain disadvantages. For example, concrete is a relatively heavy material. Thus, the use of components formed of concrete adds to the loads or forces that the building framework or other supporting structure is designed to withstand. The additional weight of such components may be quite substantial.

Additionally, certain types of components are not suitable for the utilization of pre-casting and/or mass production techniques and thus require the pouring of concrete in the field at the job site. This is both wasteful and costly since it requires the acquisition of costly forms as well as the labor expense for the erection thereof, the dismantling and/or cleaning and oiling of such forms after the concrete pouring operation has been completed.

Additionally, concrete lacks tensile strength and is therefore not suitable for the manufacture of structural components which will be subjected to tensile forces and/or flexural forces.

Accordingly, it is a principal object of the present invention to provide means and method for obviating the above-mentioned and other difficulties and limitations.

SUMMARY

These and other objects and advantages are achieved in accordance with the present invention by the provision of a pre-cast panel of suitable thickness and other dimensions and having opposed surfaces that may be either flat or suitably curved as desired.

Preferably, such a panel is formed of a fast setting cement material with reinforcing material disposed adjacent each of the aforesaid surfaces. Edge portions of the panel have a notch or channel extending along said portions with reinforcing material in the channel and extending along or parallel to said edges. When such panels are clamped together in abutting relationship, the void space defining the channels provides a mold cavity into which cement material is injected and, after setting, forms a load-bearing beam such as a column, rib, stud, joist, and the like, without requiring or utilizing a pre-erected supporting framework. After setting of the injected material, the two panels are then permanently interconnected and form an integrated unitary monolithic wall structure that is useful in the construction of many differing types of structures including receivers of solar and other kinds of radiant energy.

DESCRIPTION

Additinal objects and advantages of the invention will become apparent from the following description taken in connection with the accompanying drawings in which:

FIG. 12 is a top plan view illustrating a saucer or dome structure in accordance with the present invention;

FIG. 13 is a sectional view taken along a diameter of FIG. 1; and

FIG. 14 is a fragmentary sectional view illustrating a typical joint connecting adjacent curved panels of FIGS. 10–13 inclusive.

Figure 2:
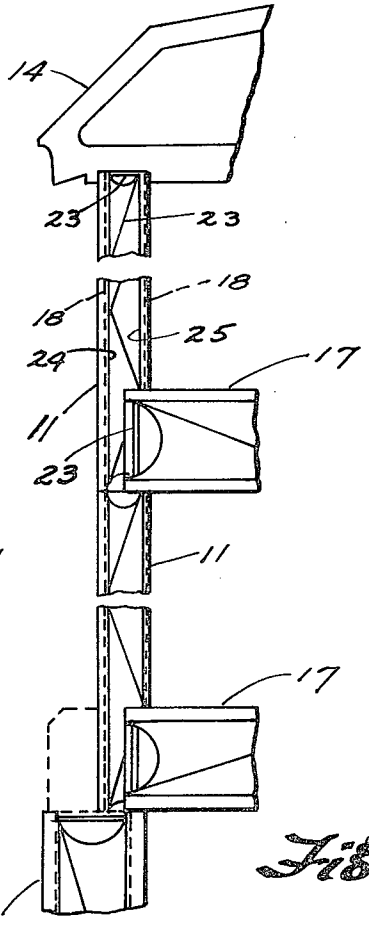
FIG. 2 is a sectional view, partly broken, illustrating a typical outer wall and floors of the embodiment of FIG. 1.

Referring now to the drawings, a typical building structure embodying the present invention is illustrated generally at 10. It is to be understood that the illustrations and descriptions in connection with such building structure are intended as being illustrative and not limiting since the present invention is useful in connection with the construction of many differing types of building structures.

Figure 1:
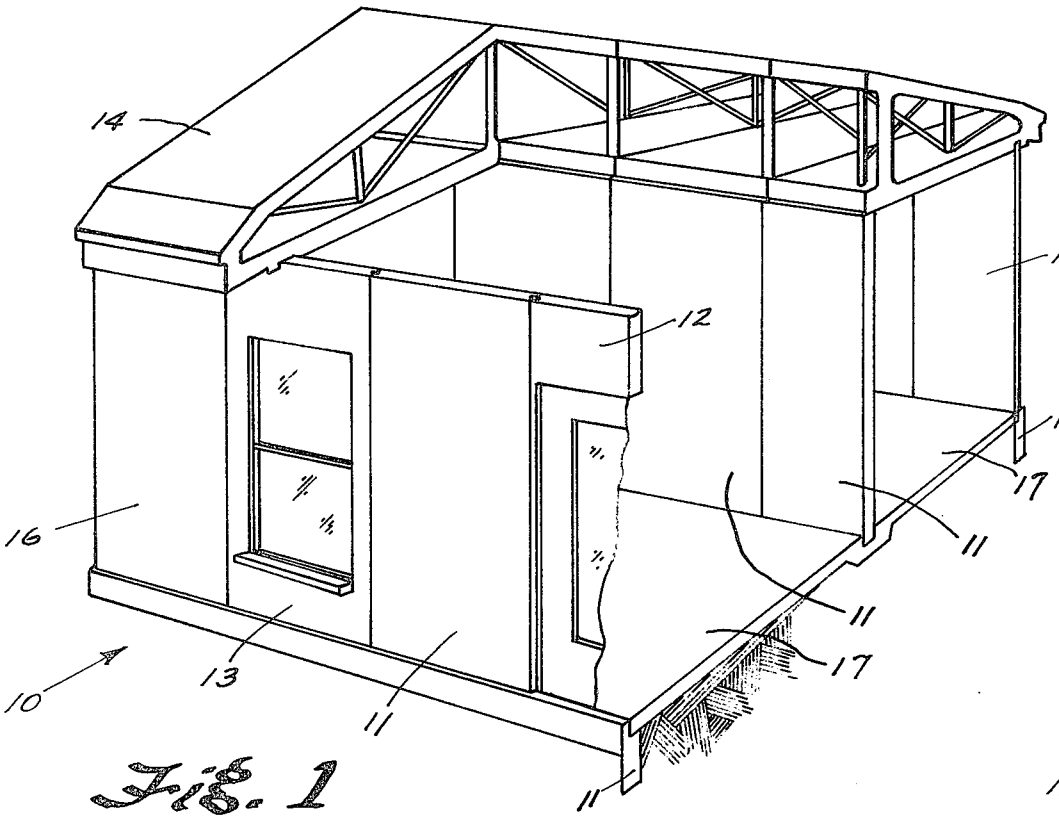
FIG. 1 is a perspective view, partly broken, of a building structure embodying the present invention.
Figure 3:
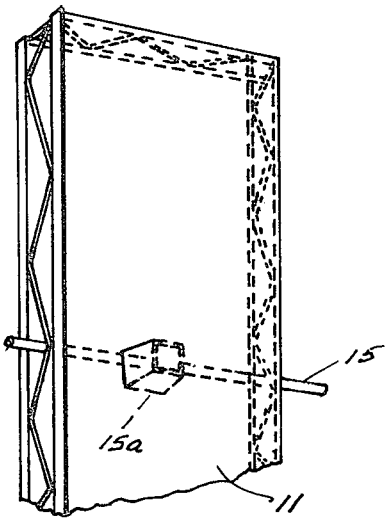
FIGS. 3–5 are perspective views of typical panels embodying the present invention.
Figure 4:
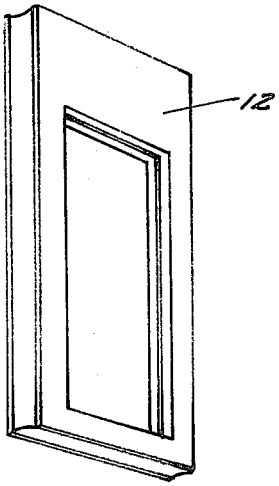
Figure 5:
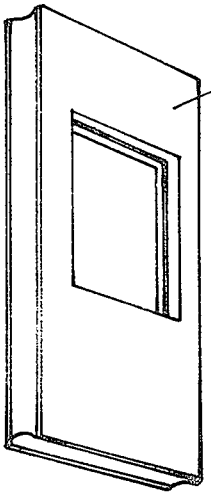

As is best shown in FIG. 1, a typical building structure embodying the present invention comprises a plurality of components such as basic wall panels 11, roof section 14, and floor panels 17, which components are fabricated by mass production techniques in a suitable manufacturing facility. These basic components may include minor modifications for particular purposes and yet the number of different basic components is kept to a minimum and, if desired, the various panels and/or other components can be standardized regarding their size including width, length, and thickness dimensions to further minimize the number of differing components that might be required. For example, a basic wall panel 11 can be formed of any desired thickness and may be either square or rectangular in shape as is best shown in FIG. 3. Also, the structure and configuration of the panels is such as to permit the inclusion therein of electrical or plumbing conduits and boxes 15, 15*a* as shown in FIG. 3. Similarly, basic panel 11 may be modified to include as part of its structure a door frame as illustrated by panel 12, or a window frame as illustrated by panel 13. Also, edge portions of basic panels may be modified to provide corner panels such as 16. Except for the above-mentioned details, the basic structure of all panels 11–16 is identical or substantially identical.

A panel embodying the present invention may be formed of a castable material that is initially plastic and which hardens after setting such as concrete, synthetic resinous materials, cement, and the like. In accordance with the present invention, the outer surfaces of such a panel can be of any desired texture and/or may include any design that may be desired from an aesthetic or architectural viewpoint.

The material from which the panel is formed may be or may contain a foamed or foamable material such as polyurethane and the like. It is desirable that a material utilized to form a panel in accordance with the present invention be one having properties, both physical and chemical, that are stable and are not subject to deterioration with age as a result of decay or a similar defect. It is also desirable that such material be fire resistant or incombustible, and that it be resistant to and unattractive to ants, termites, and the like as well as other pests.

On the basis of information presently available, a panel embodying the present invention preferably is formed of a homogenous material such as a fast setting cement with or without a plurality of cellular air-containing cavities contained within the material thereby providing a resultant structure that is relatively light in weight and having good thermal and/or sound insulating properties. Foamed cement of controllable density is now available commercially as is well-suited in connection with mass production techniques which are desirably to be employed in forming a panel embodying the present invention. If desired, the cement material may have interspersed therein an additive such as pellets of styrofoam and the like.

A panel embodying the present invention is formed in a suitable mold, now shown, since the details of suitable mold structure are well known and are not necessary to an understanding of the present invention. It will suffice to state that the mold surfaces have a configuration to produce whatever configuration, texture, and/or design may be desired on the surface of the panel to be formed.

Figure 6:
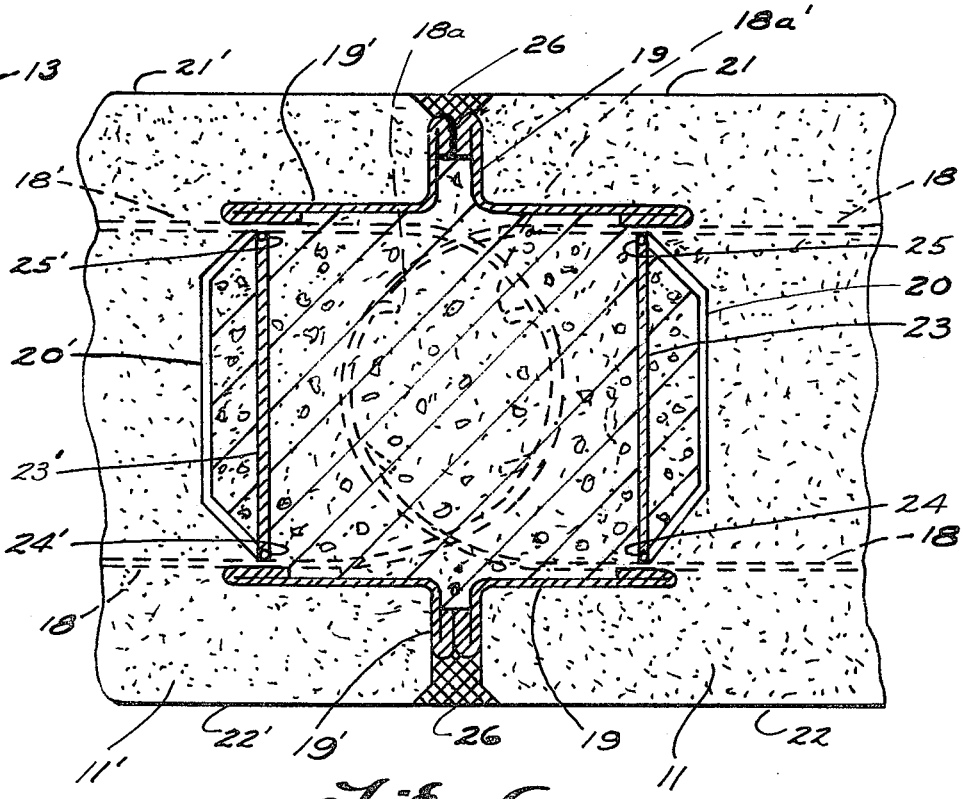
FIG. 6 is a fragmentary sectional view illustrating abutting panels joined together in accordance with the invention.

Before the casting procedure is initiated, reinforcing material is positioned within the mold cavity at desired locations in accordance with well known procedures and techniques similar to those employed in the production of objects formed of concrete whether such objects are pre-cast or are poured in suitable molds erected at the job site. In accordance with the present invention, a layer of reinforcing mesh 18 is provided and positioned adjacent each of the opposed surfaces of the resultant panel, as is best shown in FIG. 6. In order to insure that these two layers of mesh are properly positioned relative to other portions of the panel to be formed and remain so positioned during pouring operations, these two mesh layers are suitably connected by any convenient means, for example, by welding, to frame members 19, each of which is continuous and extends completely around the peripheral edge of the panel to be formed, and a suitable separator 20 is positioned between the respective mesh layers.

In FIG. 6, there are shown in abutting relationship two adjacent panels 11, 11′, each having like structural components. The prime designation has been added to the reference numerals in order to clearly distinguish between the corresponding components of the right and left-hand panels. The peripheral edge portions of panel 11 are defined by the opposed frame members 19 and separator member 20. The corresponding peripheral edge portions of panel 11′ are similarly defined by opposed frame portions 19′ and separator member 20′.

In addition to providing desired spacing and positioning means, opposed frame members 19 additionally provide means for applying tensile stress to the opposed reinforcing mesh structures 18 which, preferably, are connected to members 19 while subjected to such stress, to prevent sagging of these mesh structures. The ends of each of these reinforcing mesh structures project outwardly beyond the peripheral edges of panel 11. Each of these projecting end portions terminates at an end designated 18*a* and they are curved in opposite directions and are superimposed one upon the other to form a substantially closed loop extending outwardly beyond the peripheral edge portions of panel 11. The corresponding ends of mesh structures 18′ of panel 11′ similarly terminate in end portions designated 18*a′* and are similarly curved and superimposed for reasons which will become apparent as the description proceeds.

Thus, as best shown in FIG. 6, the vertical portions of frame members 19 define the outermost extremities of the peripheral edge portion of panel 11. The horizontal portions of frame members 19 define opposed sidewalls of a notch or channel which extends inwardly from said outer peripheral portions, the innermost boundary or margin of said channel being defined by spacer member 20. This outwardly projecting channel is open adjacent the outer marginal periphery of panel 11 and extends completely around the peripheral edges of said panel. A corresponding channel similarly extends completely around panel member 11′. When these two panel members are placed in abutting relationship, as shown in FIG. 6, the respective channels cooperatively define a closed cavity extending along the entire length of the abutting edges of these panels and disposed between opposed surfaces 21, 22 thereof.

Referring now to FIGS. 2 and 6, a pair of reinforcing members 24, 25 are connected to the lower and upper mesh structures 18, respectively, and extend along and substantially parallel to the outer peripheral margins of panel 11. Interconnected with and between members 24, 25 is another reinforcing member 23 which extends generally along and substantially parallel to the peripheral outer edge portions of panel 11 and forms a truss-like structure as is best illustrated in FIG. 2. This truss-like structure comprising members 23–25 inclusive, extends continuously and peripherally along all edges of panel 11 within the aforesaid open channel and adjacent but spaced apart from the central portion of member 20 as is best shown in FIG. 6.

After the above described components have been positioned and secured within a mold cavity the information of the panel is completed by well known casting procedures and, after setting of the castable material, the formation of the panel is complete and it can then be removed from the mold. While the positioning of components has been described in reference to a single panel 11 and pouring within a single mold structure, it is to be understood that the use of multiple molds or multiple cavity molds and continuous pouring techniques are contemplated within the scope of the present invention as well as any other techniques that are well suited for mass production of such panels. Normal manufacturing tolerances present no problems regarding manufacture, use, or assembly of structural components embodying the present invention.

In accordance with the present invention, a pre-erected framing structure is neither required nor utilized in the assembly of a building, walls, or other components. Two adjacent panels 11, 11' are aligned and placed in abutting relationship, as shown in FIG. 6. After the surfaces 21, 22 are plumbed or leveled, as the case may be, the panels are clamped together and a plug or gasket 26 may be interposed therebetween. When so positioned and clamped, the inwardly extending open channels in each of their respective edges then defines an enclosed cavity which extends along the entire length of the abutting peripheral edge portions. Within said cavity there is then disposed the looped end portions of the reinforcing mesh 18, 18' as well as the truss-like reinforcing members 23, 24, 25 and 23', 24', 25', as is best shown in FIG. 6. Castable material which can be the same as that employed in the formation of the individual panels is then injected into said enclosed cavity, preferably from the bottom upwardly, to avoid possible entrapment of air within the enclosed cavity and to insure that said cavity is completely filled with the injected material. After the injected material has set, it hardens and forms a monolithic structure in which the adjacent panels are securely bonded to and form a unitary structure in which the material injected into the aforesaid cavity is now also securely bonded to the reinforcing members and thereby forms a strong, load-bearing structural member such as a beam, column, post, rib, and the like. In the event that one or more peripheral edges of a panel 11 are not to be so joined to another panel, member 20 is positioned substantially flush with the outer edges of frame members 19.

Figure 7:
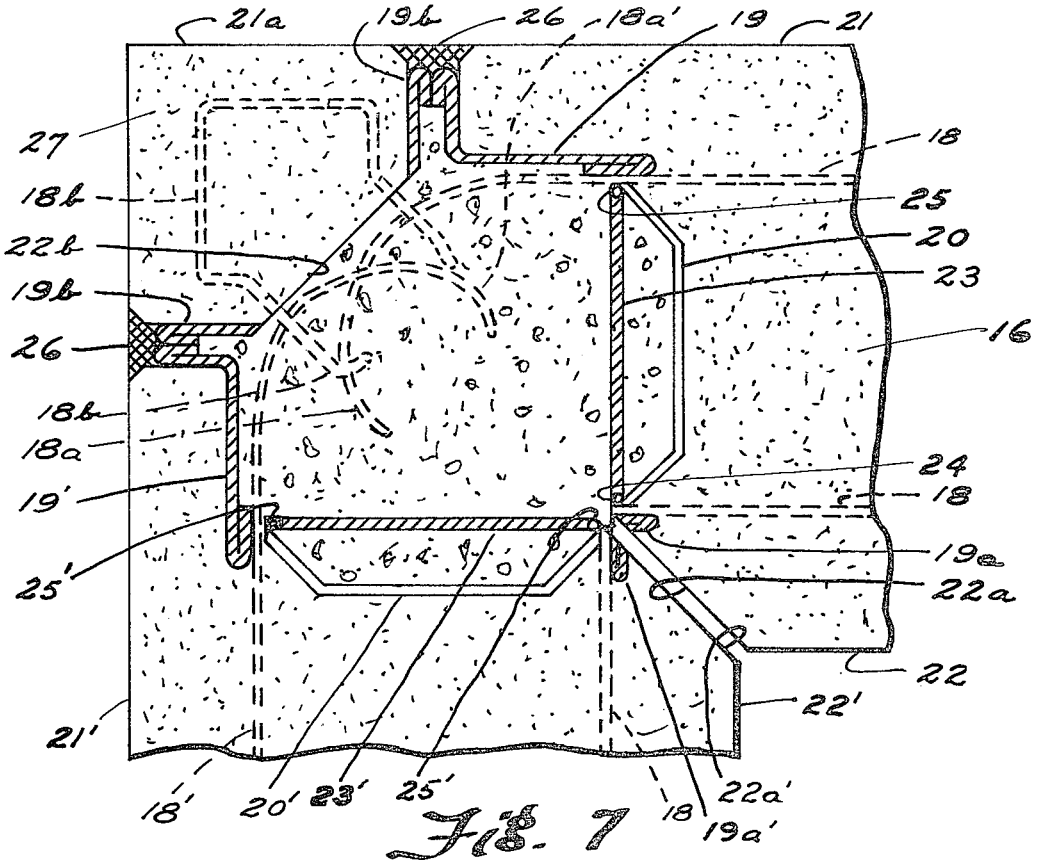
FIG. 7 is a fragmentary sectional view showing adjacent panels joined together and forming a corner.

In FIG. 7, there is illustrated a modification of the basic panels wherein like components bear like designations. Panels 16, 16' are essentially identical with basic panels 11, 11'. They differ principally in the provision of a modified frame **19*a*, 19*a'* and mitered corners 22*a*, 22*a'* so that panels 16, 16' can be angularly disposed relative to one another in the formation of a corner joint. In FIG. 7, the spacing between surfaces 22*a*, 22*a'*** is actually very small but is shown on an enlarged scale for purposes of clarity.

In the construction illustrated in FIG. 7, the peripheral edge portions of surfaces 21, 21' are spaced apart, thereby leaving an opening that extends along the length of the corner formed by adjacent panels 16, 16'. Accordingly, there is provided an additional panel member 27 having angularly disposed outer surfaces **21*a*, 21*a'*** angularly disposed relative to one another for closing said opening.

Panels 16, 16' have peripheral edge portions which define a notch or channel, the cross-sectional shape of which is defined by that portion of frame 19 that is shown parallel to surface 21 and by the spacer member 20. A similarly shaped complimentary channel is formed along the peripheral edge portion of panel 16', and the corner opening resulting from the spacing between frame members 19, 19' is closed by inner surface **22*b* and portions of frame members 19*b* of corner member 27. When panels 16, 16' and corner member 27 are positioned and clamped together, as shown in FIG. 7, the inner surfaces of corner member 27 and the channels formed in the peripheral edges of panels 16, 16' define an enclosed cavity into which cement material is injected and which, after setting, forms a central corner post or column and provides a monolithic structure in which panels 16, 16' and corner member 27** are securely connected together to from a unitary structure.

Figure 8:
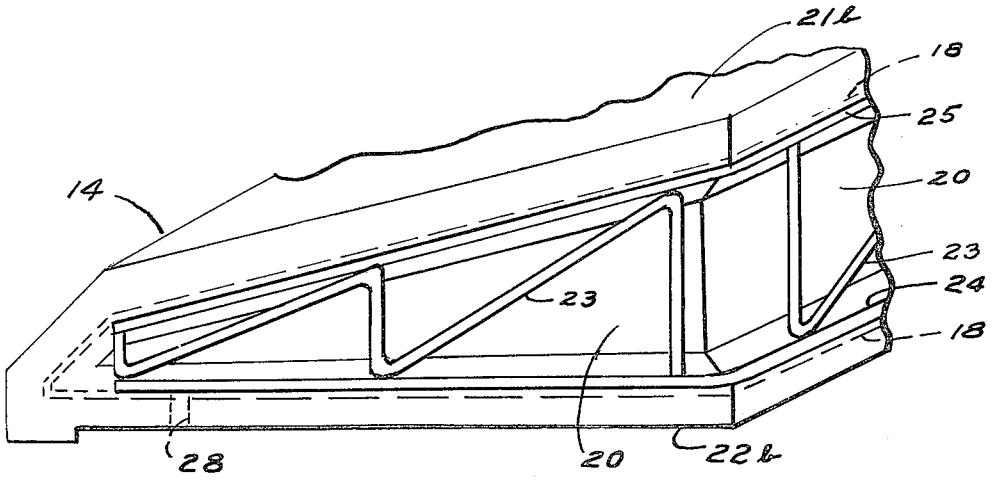
FIG. 8 is a perspective view, partly broken, of a typical roof section embodying the present invention.

The roof panel shown in FIG. 8 is also essentially like panel 11 shown in FIG. 6. Again, like components bear like designations. Roof panel 14 differs principally in that upper and lower surfaces **21*b* and 22*b* are angularly disposed relative to one another and one or more ports 28 are provided along and adjacent peripheral edges of surface 22*b*** to facilitate the injection of cement material into the enclosed cavity defined between adjacent roof panels when they are aligned and clamped together.

Figure 9:
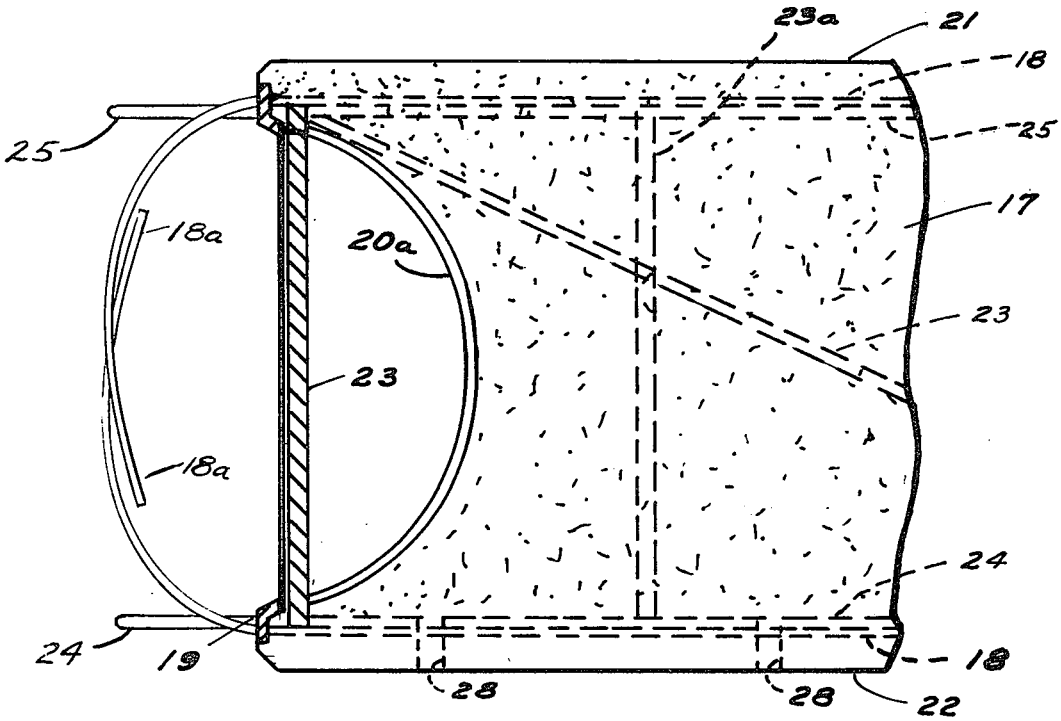
FIG. 9 is a fragmentary sectional view of a typical floor panel.

FIG. 9 shows a floor panel which is essentially like panel 11. Again, like components bear like designations. Floor panel 17 differs from panel 11 primarily in that its thickness may be increased to provide additional strength and also may include additional truss-like reinforcing members **23*a* to provide additional strength. If desired, the shape of spacer member 20*a* may be varied, and one or more projection ports 28 may be provided along an adjacent peripheral edge portions of lower surface 22. If a foundation panel is required, it can be constructed essentially like the floor panel 17 except that ports 28** can be eliminated.

The present invention is not limited to panels and/or walls having flat or substantially flat outer surfaces. The invention is equally applicable and useful in connection with the erection of dome or saucer-like wall structures and/or trough-like vessels from curvilinear panel components and/or a combination of rectilinear and curvilinear panel components.

Figure 10:
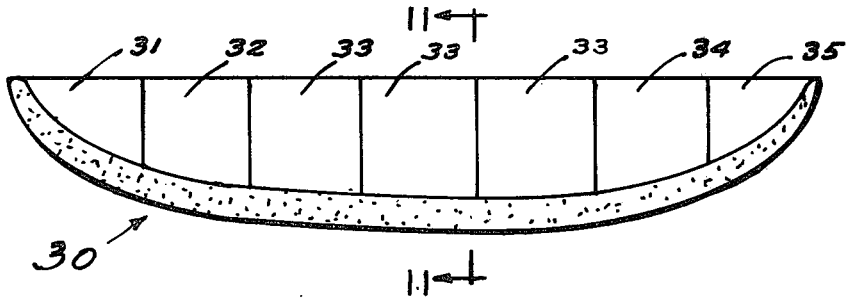
FIG. 10 is a sectional elevational view of an elongated trough structure embodying the present invention.
Figure 11:
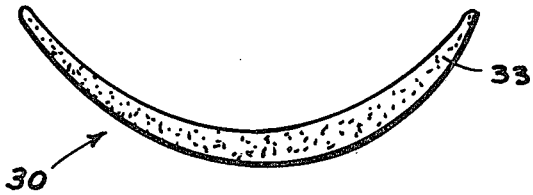
FIG. 11 is a sectional view looking in the direction of arrows 11—11 of FIG. 10.

For example, in FIGS. 10–11, an elongated trough-like wall structure having curved wall panel portions is illustrated generally at 30. The trough-like structure comprises a plurality of panel portions 33 all of which are identical, as well as other panel portions that are similar, such as 31, 35 and 32, 34. Panel portions 31–35 inclusive all have components that are identical with those described above in connection with panel 11 in FIG. 6 including reinforcing meshes 18, frames 19, and integrally connected truss-like members 23, 24, 25.

Similarly, in FIGS. 12 and 13, a saucer or dome-like wall structure is designated generally at 36. The saucer or dome-like structure comprises a central panel having a circular peripheral margin and having either flat or curved opposed surfaces, a plurality of panel portions 28 that are essentially pie-shaped and having opposed curved wall surfaces; as well as a plurality of other wall portions 39 having quadrilateral peripheral edge portions and having curved and opposed surface portions. Panels 37–39 inclusive also include individual components like those described in connection with FIG. 6 including meshes 18, frames 19, and integrally connected truss-like reinforcing members 23, 24, 25.

A typical joint useful for interconnecting adjacent panels of the type shown in any of the foregoing figures, i.e., flat and/or curved is illustrated in FIG. 14. The joint illustrated in FIG. 14, as well as the load-bearing member formed by the injection of cement material into the enclosed cavity defined by the notches and/or channels formed in adjacent panel members after they have been aligned and clamped together is identical to that shown and described in connection with FIG. 6.

In certain instances, it may be desirable to apply to panel surfaces 21, 22 a protective coating of material such as a penetrating epoxy resin to obtain whatever surface characteristics may be desired such as, for example, sealing, weather and/or abrasion resistance, resistance to the formation of shrinkage cracks, and the like, and generally to maintain an attractive appearance and desired aesthetic effect. Additionally, it may be desirable to apply to exposed portions of the joint panels adjacent and along the juncture a suitable sealing and/or protective material such as an epoxy resin prior to the insertion of plug 26.

From the foregoing, it is believed that it will be readily apparent that the panel components and/or the method of construction of structure according to the concept of the present invention is quite different from methods employed heretofore. According to the present invention, the need for the erection of a framing structure prior to the erection of wall components is eliminated, as well as the need for concrete forms, their care and cleaning and overall maintenance, labor costs connected with their erection and dismantling at the job site after completion of concrete pouring operations. Instead, the present invention contemplates the provision of components which are pre-cast in a shop by mass production techniques. According to the invention, such pre-cast panels can be manufactured in a relatively small number of configurations that differ from one another but otherwise can be more or less standardized as to configurations, dimensions, shapes, curvature, etc.

When it is desired to erect a wall structure in accordance with the present invention, the appropriate number and kind of panel portions is selected and supplied to the job site. Appropriate individual panels are aligned and plumbed or leveled and then clamped together in desired configuration, following which fast setting cement material of appropriate density is injected into the enclosed cavity which formed when adjacent panel edge portions are clamped together. Upon completion of the injection process and upon setting of the cement material, the joint between adjacent panels then includes a load-bearing, frame-like member integrally connecting said member and each of the adjacent panel portions to form a unitary monolithic structure. By the selection of the limited number of panel configurations, a wide variety of ultimate wall structures can be formed with opposing wall surfaces of the resulting structure disposed relative to one another in virtually unlimited number of differing configurations.

As noted heretofore, the individual panels are formed of a material which hardens upon setting to provide a durable wall structure, and the manufacturing method in accordance with the present invention enables the use of opposing surfaces of the individual panels to be of almost any desired texture or design configuration in order to provide whatever overall aesthetic or architectural effect may be desired. Additionally, the mass production techniques contemplated by the present invention enable the formation of individual panels, as well as the erection of a wall structure of widely differing configurations therefrom, to be accomplished simply and economically at reasonable cost, and avoids unnecessary cost expenditures through the elimination of procedures, labors, and equipment that is not essential and does not form a part of the ultimate wall structure to be produced.

While particular embodiments of the invention have been illustrated and described, it will be obvious that various changes and modifications can be made without departing from the invention and it is intended in the appended claims to cover all such changes and modifications that fall within the true spirit and scope of the invention.

What is claimed is:

1. A structural component for use in erecting a frameless structure comprising a panel formed of a cement material and having a pair of opposed surfaces with a peripheral edge portion extending between said surfaces, reinforcing mesh members extending through said panel and disposed closely adjacent each of said surfaces, a separator member disposed between said reinforcing members and extending along said peripheral edge portion, a truss-like member interconnected to and between said reinforcing mesh members at a location between said edge portion and said separator member and extending along the extent of and adjacent said edge portion, and walls extending between said edge portion and said separator member and defining therewith a channel disposed between said opposed surfaces and extending along said peripheral edge, said reinforcing mesh members each having curved distal ends disposed between said channel-defining walls and projecting outwardly from said separator member and beyond said peripheral edge for connection to another member when said latter member is disposed in said channel.

2. An article according to claim 1 and additionally including means connected to said panel adjacent said edge and subjecting said reinforcing members to tensile stress.

3. Structure comprising at least two components each according to claim 1, said components being disposed with their respective peripheral edge portions in abutting relationship, and additionally including a load-bearing member formed of cement material disposed within each of the respective channel portions extending along said abutting edge portions and interconnected between said two components to form a unitary monolithic entity.

* * * * *